US005995791A

United States Patent [19]

Kawasaki

[11] Patent Number: 5,995,791

[45] Date of Patent: Nov. 30, 1999

[54] DEVELOPING APPARATUS HAVING A REGULATING MEMBER

[75] Inventor: Akihiro Kawasaki, Itami, Japan

[73] Assignee: Minolta Co., Ltd., Osaka, Japan

[21] Appl. No.: 09/201,782

[22] Filed: Dec. 1, 1998

[30] Foreign Application Priority Data

Dec. 3, 1997 [JP] Japan ..... 9-333304

[51] Int. Cl.[6] ..... G03G 15/08

[52] U.S. Cl. ..... 399/281; 399/258

[58] Field of Search ..... 399/27, 29, 252, 399/253, 254, 255, 256, 279, 281, 282; G03G 15/08

[56] References Cited

U.S. PATENT DOCUMENTS

| | | | |
|---|---|---|---|
| 4,993,829 | 2/1991 | Naganuma et al. | 399/260 |
| 5,239,343 | 8/1993 | Sakemi et al. | 399/275 |

FOREIGN PATENT DOCUMENTS

| | | |
|---|---|---|
| 4-51067 | 2/1992 | Japan . |
| 4-56979 | 2/1992 | Japan . |
| 4-86868 | 3/1992 | Japan . |
| 4-116580 | 4/1992 | Japan . |
| 4-140778 | 5/1992 | Japan . |
| 4-172475 | 6/1992 | Japan . |
| 4-198968 | 7/1992 | Japan . |
| 5-134538 | 5/1993 | Japan . |
| 5-158331 | 6/1993 | Japan . |
| 5-158345 | 6/1993 | Japan . |

*Primary Examiner*—Arthur T. Grimley
*Assistant Examiner*—Hoang Ngo
*Attorney, Agent, or Firm*—Burns, Doane, Swecker & Mathis, LLP

[57] ABSTRACT

The developing apparatus has: a development sleeve; a supply roller; a toner hopper; a stirring member; and a partition member. The partition member and a regulating blade form a space. The supply roller supplies toner to lower part of the space. Thereby, toner present in the proximity of the development sleeve circulates smoothly. Therefore, the following situation will be prevented: 1) since same toner particles are repeatedly stressed by regulation of the regulating blade, toner particles crack; 2) cracked tiny particles of toner melt and adhere to the development sleeve; or 3) the regulating blade gets stiff due to the cracked toner adhering thereto. Further, since constant amount of toner is always collected within the space, appropriate pressure of toner is applied at the regulating position when the regulating blade takes toner into the space.

16 Claims, 9 Drawing Sheets

DEVELOPING APPARATUS HAVING A REGULATING MEMBER

This application is based on application No. 9-333304 filed in Japan, the contents of which is hereby incorporated by reference.

BACKGROUND OF THE INVENTION

1. Field of the Invention

The present invention relates to a developing apparatus which is used for electrophotographic type copy machine and printer. More particularly, the present invention relates to a developing apparatus wherein both the developer to be carried onto a developer carrier supplied from a developer supply portion and the developer present in a developer tank surely circulate so that the developing apparatus can obtain appropriate pressure of developer.

2. Description of the Prior Art

A known conventional developing apparatus used for electrophotographic type copy machine and printer is such that non-magnetic one-component developer not including carrier is used and the developer is supplied onto a developer carrier and forms thin layer of developer on the developer carrier before development.

An example of such a conventional developing apparatus is shown in FIG. 12. In a developing apparatus 100, a toner hopper 106 for accommodating developer is arranged at a position lower than a position where a development sleeve 103 is rotatably installed. The developing apparatus 100 has: a supply roller 104 for supplying developer, i.e., toner, to the development sleeve 103; and a stirring member 107 for stirring toner present in the toner hopper 106. A regulating blade 102 is made to press periphery of the development sleeve 103. The regulating blade 102 is provided so as to make thickness of thin layer of toner to be formed on the development sleeve 103 uniform and make toner negatively charged.

In the developing apparatus 100, the supply roller 104 supplies toner to the development sleeve 103. Next, the toner supplied to the developing sleeve 103 is regulated by the regulating blade 102, then carried onto the development sleeve 103 in a thin layer state. After that, the thin layer of toner gets electrostatic latent images on a photosensitive drum 90 developed. On the other hand, toner not carried onto the development sleeve 103 is returned to the toner hopper 106 and mixed with toner present in the toner hopper 106.

However, in the development apparatus 100, a developer supply portion for supplying developer to the development sleeve 103 can collect a little amount of toner. Since the toner hopper 106 is arranged at a position lower than the position of the development sleeve 103, toner has to be drawn up from the toner hopper 106 to supply to the development sleeve 103. Thereby, there has been a problem that pressure of toner applied to the development sleeve 103 gets low because weight of toner is too light to generate appropriate pressure. When the pressure of toner is low, the development sleeve 103 can take a little toner through the regulating blade 102 and as a result, the deterioration of toner-taking condition at the development sleeve 103 causes following deterioration on a high-density image at a large area, or the like.

Different from the developing apparatus 100, there has been a conventional developing apparatus wherein a toner hopper is arranged above a development sleeve.

Such a conventional developing apparatus does not have a following-deterioration kind problem. However, there has been a problem that the toner present at a developer supply portion and the toner present in a toner hopper do not circulate well. That is, since the toner hopper is arranged at a position higher than the position of the development sleeve, the developer supply portion is covered with toner and pressure of toner applied thereto becomes high. Thereby, the following problems have occurred to the conventional developing apparatus: same toner particles repeatedly receive stress by regulation of a regulating blade and then, the stress causes the toner particles to crack; the cracked tiny powder of toner melts and adheres to the development sleeve; or the regulating blade gets stiff because of cracked toner adhering thereto, whereby image quality deteriorates.

As described, in conventional developing apparatus, pressure of developer applied at a regulating position where a regulating member regulates developer is not constant. Thereby, there have been inconveniences: following deterioration on a high-density image occurs due to deterioration of toner-taking condition at a development sleeve when the pressure of developer is insufficient; or developer present at the regulating position adheres thereto when the pressure of developer is too high.

SUMMARY OF THE INVENTION

The present invention is intended to solve the above-described problems of the conventional developing apparatus. Its prime object is to provide a developing apparatus wherein the developer carried from a developer supply portion to a developer carrier and the developer in a developer tank are made to circulate smoothly so that appropriate pressure of developer can be applied at a regulating position where a regulating member regulates developer.

In order to achieve the above objectives, the inventive developing apparatus includes: a developer carrier for carrying developer; a regulating member contacting with the developer carrier; a space having an upper opening and a lower opening, and including a regulating position at which the developer carrier and the regulating member contact in the vicinity of the lower opening; a developer tank for accommodating developer; and a supply unit; wherein the supply unit does not supply developer present in the developer tank to the upper opening directly but supply developer from the lower opening to the upper opening and includes a supply device for collecting excessive developer in the developer tank.

In this developing apparatus, the supply device having a stirring member and a rotating roller supplies the developer within the developer tank to a space surrounded by the regulating member and a partition member. Developer is supplied to the space from the lower opening but not from the upper opening. The developer present in the space is pushed upward by the developer newly supplied, then overflows from the upper opening, and it is collected in the developer tank after all. Thereby, circulation of developer is formed within the developing apparatus. In the circulation of developer, the developer taken into the space by the regulating member is carried onto the developer carrier uniformly. Since appropriate amount of developer is normally collected when developer is taken into the space, appropriate pressure of developer can be applied at the regulating point.

In this case, the space between the partition member and the developer carrier or between the partition member and the rotating roller is preferably set at less than 1 mm. When the space is big, developer flows backward. Thereby, developer is prevented from forming a flow running from bottom to top within the space and appropriate amount of developer cannot be collected within the space.

In this case, the developer carrier or the rotating roller is preferably made to contact with the partition member. Thereby the developer supplied from the developer tank can surely be prevented from flowing backward. Pressure of the partition member to press the developer carrier, or the rotating roller, has to be made smaller than that of the regulating member to press the developer carrier: when all the developer carried onto the developer carrier is consumed, developer of more than consumed amount has to be supplied.

Further, in this case, when the sectional area of the lower opening and that of the upper opening are referred to as (F1) and (F2), respectively, the ratio (F2/F1) preferably satisfies the following expression:

$$0.8 \leqq (F2/F1) \leqq 3.0$$

This is to secure fluidity of developer within the space and to secure good circulation of developer.

Further, the inventive developing apparatus preferably has a toner-empty sensor for sensing presence/absence of developer within the space.

Since developer is continuously supplied to the space from the developer tank in normal operation, the amount of developer collected within the space is constant. However, when developer present in the developer tank runs out, the supply of developer to the space is stopped. Subsequently, developer in the space is only consumed, i.e., the amount of the developer begins to decrease, appropriate pressure of toner applied at the regulating position is lost finally. Therefore, toner needs replenishing. Thereby, employment of a toner-empty sensor is recommended so that an operator can find out an appropriate timing to replenish toner with the sensor. Thereby, appropriate amount of toner can be collected within the space constantly.

Alternatively, the inventive developing apparatus preferably has a changing device for changing volume of the space.

In the space, the height of developer wherein developer can flow from bottom to top without staying varies in response to flow speed and fluidity of developer. Volume of the space can be changed by arranging the changing device to the developing apparatus. Since the amount of toner collected within the space, that is, length of the regulating member and partition member is constant in width direction, height of toner can be changed. Thereby, the flow of developer can be formed within the space constantly and good circulation of developer can be secured. Accordingly, appropriate amount of developer is collected within the space constantly and appropriate pressure of developer can be applied at the regulating position.

In this case, the changing device is preferably made to change volume of the space based on operation-environment information of developer: flow speed of developer changes in response to printing speed; fluidity of developer changes in response to change of developer after durable use; and change of electrostatic force and cross-linking force of liquid affected by environmental change, such as humidity change. That is, since flow of developer is surely formed by changing volume of the space in response to the operation-environment of the developing apparatus, good circulation of developer is secured.

DESCRIPTION OF THE PREFERRED EMBODIMENTS

The detailed aspects of embodiments for the inventive developing apparatus will be explained based on the drawings. The embodiments relate to a developing apparatus using non-magnetic one-component developer for an electrophotographic type image forming apparatus.

[First Embodiment]

Figure 1:
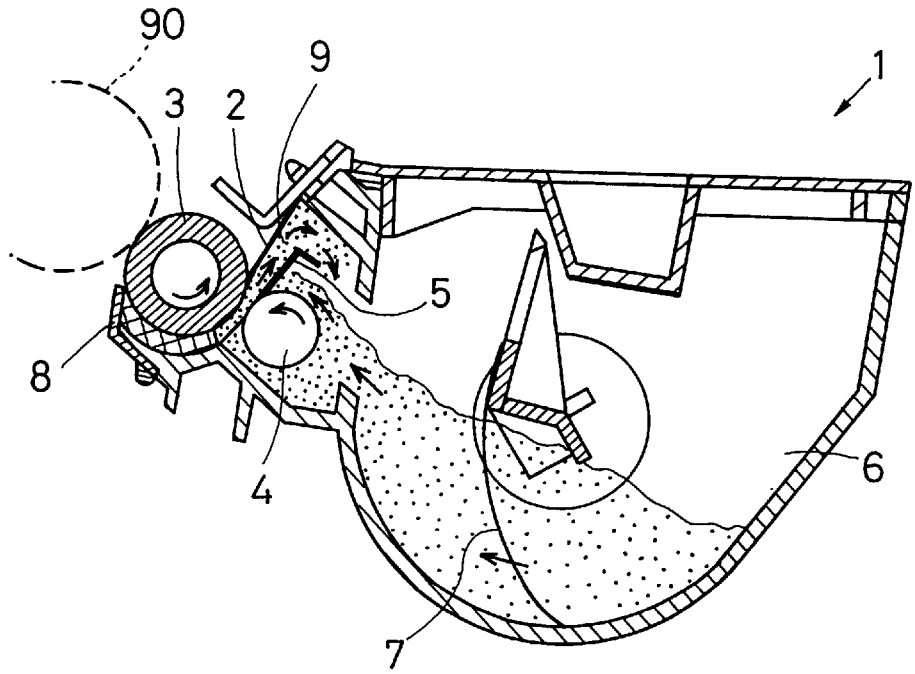
FIG. 1 is a schematic diagram showing a developing apparatus according to the first embodiment.

The first embodiment will be explained. As shown in FIG. 1, a developing apparatus 1 according to the first embodiment includes: a development sleeve 3; a supply roller 4 for supplying toner to the development sleeve 3; a toner hopper 6 for accommodating toner to be supplied to the supply roller 4 and the development sleeve 3; and a stirring member 7 for stirring toner within the toner hopper 6 and supplying toner to the supply roller 4. The development sleeve 3 is made of nylon kind material, has a cylindrical body (flexible sleeve) with resistance value of $10^6$–$10^8$ Ω/□, and is rotatably installed with a part of it protruding from the toner hopper 6.

Further, a charge-eliminating member 8 is made to press and contact with the lower part of the development sleeve 3. A voltage for eliminating charge, that is, voltage with opposite polarity for charged toner, is made to be applied to the charge-eliminating member 8 so as to eliminate charge of toner remaining on the development sleeve 3 after development. Moreover, the regulating blade 2 is arranged at a point where the development sleeve 3 and the supply roller 4 face to each other, with its upper part fixed to the toner hopper 6 and with its edge bent in a certain angle. The regulating blade 2 is provided to make amount of toner carried onto the development sleeve 3 uniform and make toner negatively charged with friction.

On the other hand, the partition member 5 is arranged above the supply roller 4 facing to the regulating blade 2, with its lower edge contacting with the supply roller 4. Thereby, constant amount of developer is supplied from the supply roller 4 to the development sleeve 3 passing under lower part of the partition member 5. The partition member 5 is provided, whereby the partition member 5 and the regulating blade 2 form a space 9 and constant amount of toner can be collected within the space 9.

Figure 2:
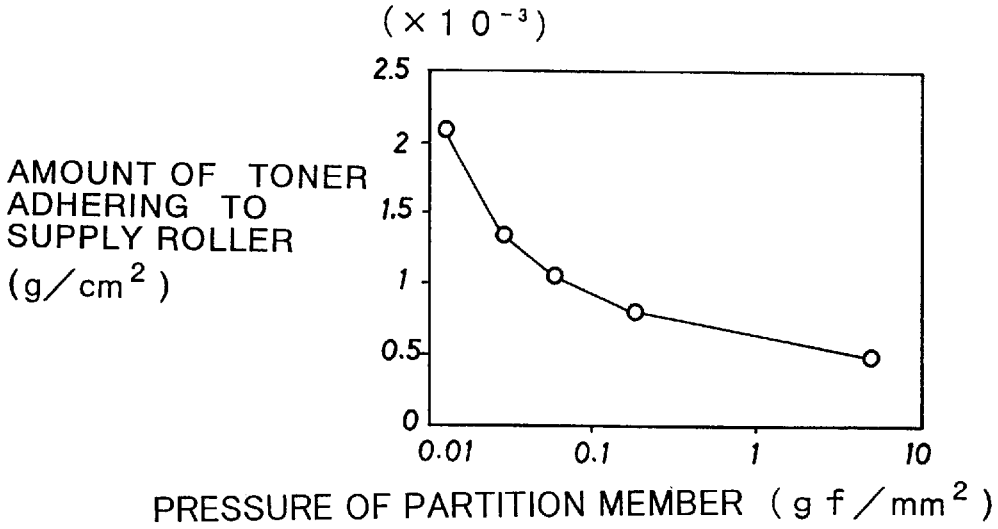
FIG. 2 shows the relation between pressure of a partition member to press a supply roller and amount of toner adhering to the supply roller.

The pressure of the partition member 5 to press the supply roller 4 will be explained with FIG. 2. FIG. 2 shows how smoothly and what amount of toner beneath the partition member 5 passes against the pressure of the regulating member 5 to press the supply roller 4. Here, the amount of toner which can pass between a partition member 5 and a supply roller 4 is indicated as amount of toner adhering to the supply roller 4 and measured with weight per unit area on the supply roller 4.

As shown in FIG. 2, as the pressure of the partition member 5 to press the supply roller 4 increases, the amount of toner adhering to the supply roller 4 reduces. In other words, toner gets hard to pass. Consequently, amount of toner supplied to the development sleeve 3 reduces. On the other hand, amount of toner carried onto the development sleeve 3 is determined by the pressure of the regulating blade 2 to press the development sleeve 3. Provided that all the toner carried onto the development sleeve 3 is consumed, toner of same or more amount of consumed toner needs to be supplied. That is, the amount of toner to be taken by the regulating blade 2 needs to be made more than the amount of toner supplied from the supply roller 4 to the development sleeve 3. Accordingly, the pressure of the partition member 5 to press the supply roller 4 has to be set smaller than the pressure of the regulating blade 2 to press the development sleeve 3. In this embodiment, the pressure of the regulating blade 2 to press the development sleeve 3 is set at 5 gf/mm$^2$ and the amount of toner adhering to the development sleeve 3 is $5\times10^{-4}$ g/cm$^2$ at this point. When the pressure of the partition member 5 to press the supply roller 4 is set at 5 gf/mm$^2$, the amount of toner adhering to the supply roller 4 is also $5\times10^{-4}$ g/cm$^2$. This means that the pressure of the partition member 5 to press the supply roller 4 should be set at less than 5 gf/mm$^2$.

Figure 3:
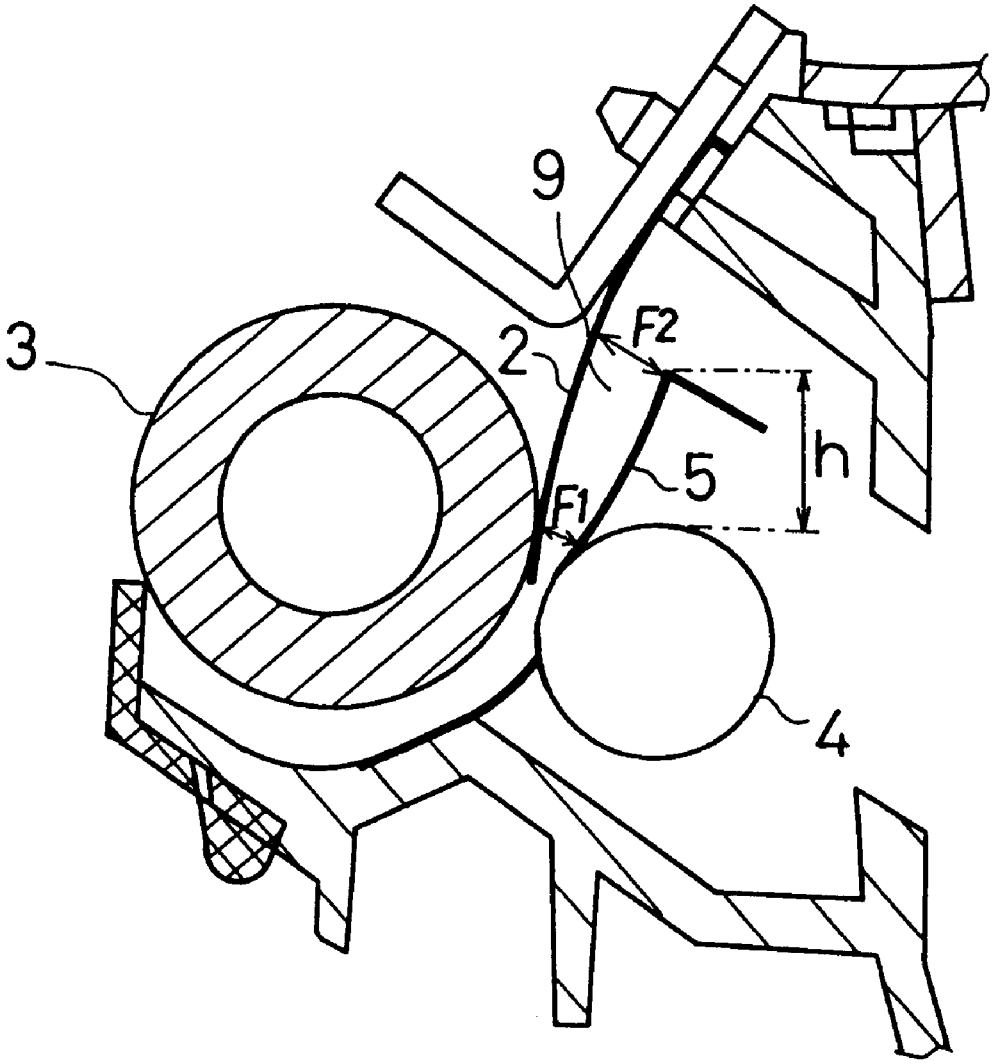
FIG. 3 is a magnified diagram showing the vicinity of a development sleeve according to FIG. 1.

Further, fluidity of toner affected by conditions of a flow path formed by the partition member 5 and the regulating blade 2 will be explained with FIG. 3 and Table 1. FIG. 3 is to indicate a sectional area of entrance (hereafter referred to as F1), a sectional area of exit (hereafter referred to as F2), and height of the partition member 5 (h). Table 1 is to show condition of toner fluidity responding to area ratio of the flowing path illustrated in FIG. 3: (F2/F1). When (F2) is much smaller than (F1), it is apparent for toner fluidity to deteriorate. On the other hand, when (F2) is larger than (F1), as (F2) is made larger, flow speed at the exit becomes slower. This is reasonable when flow of toner is regarded as a successive model of non-compressive fluid, that is, product of (F1) multiplied by flow speed at the entrance equals to product of (F2) multiplied by flow speed at the exit. In this situation, toner fluidity deteriorates, after all. As shown in the Table 1, when area ratio (F2/F1) exceeds 3.0, condition of toner fluidity becomes worse. When (F2) is smaller than (F1), toner fluidity is good at 0.8 or more for area ratio (F2/F1). Accordingly, fluid path of toner needs to meet condition that the area ratio (F2/F1) is within a range from 0.8 to 3.0, wherein fluidity of toner has to be secured and tolerance is needed.

TABLE 1

| AREA RATIO (F2/F1) | CONDITION OF TONER FLUIDITY |
|---|---|
| 0.4 | X~Δ |
| 0.6 | Δ~○ |
| 0.8 | ○ |
| 1.0 | ○ |
| 1.5 | ○ |
| 2.0 | ○ |
| 2.5 | ○ |
| 2.8 | ○ |
| 3.0 | ○ |
| 3.2 | Δ~○ |
| 3.5 | X~Δ |

(○: GOOD X: BAD)

Figure 4:
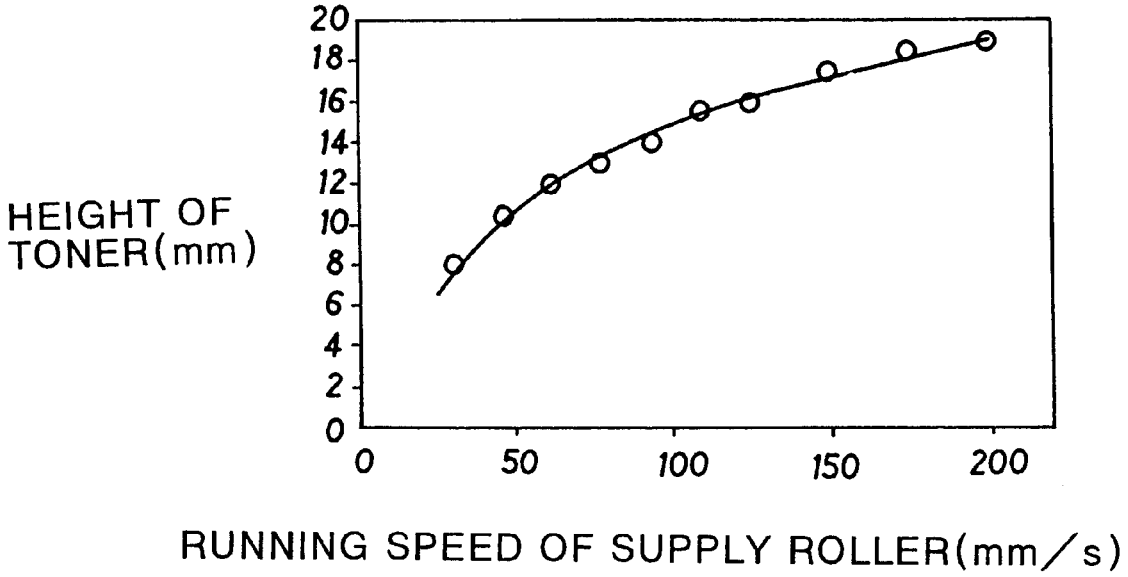
FIG. 4 shows the relation between running speed of supply roller and height of toner.

Next, height h for the partition member 5 will be explained with FIG. 4. FIG. 4 shows the relation between running speed of the supply roller 4 and height of toner. The height of toner herein means the height of toner piling up within the space 9. As shown in FIG. 4, it is apparent that the height of toner becomes higher as the running speed of the supply roller 4 gets faster.

Figure 5:
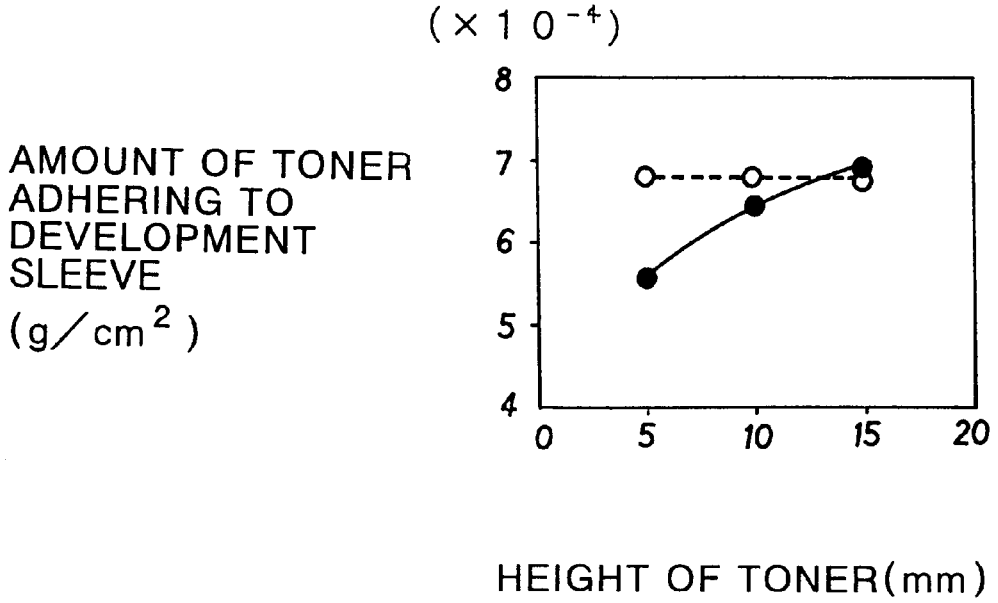
FIG. 5 shows the relation between height of toner in a space and amount of toner adhering onto development sleeve.

FIG. 5 shows amount of toner adhering to the development sleeve 3 when the height of toner is changed. In FIG. 5, a solid line shows a case where a black solid image is printed on entire area of a printing sheet and a broken line shows a case where a blank image is printed. According to FIG. 5, in the case of blank image, the amount of toner to adhering to the development sleeve 3 is full since the toner adhering to the development sleeve 3 is not consumed, whereby, it is concluded that the amount of toner to adhering thereto does not depend on height of toner. On the other hand, in case of a black solid image, the amount of toner reduces as the height of toner gets shorter, since amount of toner consumed is more than amount of toner supplied. This is because as the height of toner gets shorter, pressure of toner's own weight to press the development sleeve 3 gets reduced, whereby the regulating blade 2 cannot take toner well. Thereby, following deterioration on a black solid image occurs because of deterioration of toner-taking condition at the development sleeve 3.

Accordingly, in order to prevent the following deterioration on a black solid image, height of toner needs to be higher than a certain height. That is, toner of same amount as toner for blank image needs to be carried onto the development carrier even when a black solid image is printed on entire area of a printing sheet. Accordingly, it is apparent from the FIG. 5 that height of toner has to be made higher than 13 mm. Therefore, in this embodiment, the height h for the partition member 5 is set at height where height of toner can be 13 mm and in this case, the height h is set at 7 mm.

Next, operation of the developing apparatus 1 will be explained. First, toner within a toner hopper 6 is stirred and pushed out to a supply roller 4 by a stirring member 7 which rotates in the arrow direction in the figure. Then, toner charged with friction by contacting with the rotating supply roller 4 adheres to periphery of the supply roller 4 due to static electricity. Further, the charged toner is transported to the point where the supply roller 4 and the development sleeve 3 face to each other along with the rotation in the arrow direction and then supplied to the development sleeve 3. At this moment, toner passes through the partition member 5, whereupon the amount of toner supplied to the development sleeve 3 is made always constant. Then, toner carried onto the periphery of the development sleeve 3 is transported to contact zone where the development sleeve 3 contacts with the regulating blade 2 along with rotation of the development sleeve 3 in the arrow direction. At this point, since the space 9 surrounded by the regulating blade 2 and the partition member 5 is filled with constant amount of toner, appropriate pressure of toner is applied at the regulating position. Thereby, following deterioration on high-density image with a large area, which is likely to occur because of deterioration of toner-taking condition at the regulating blade 2, is prevented.

After that, toner carried onto the development sleeve 3 in a uniform thin-layer state is further transported to the arrow direction. Then, at the development zone where the development sleeve 3 and a photosensitive drum 90 contact with each other, toner is supplied to electrostatic latent image formed on the photosensitive drum 90. Thereby, the electrostatic latent image gets developed and the toner image emerges therefrom.

On the other hand, the toner which was supplied to the development sleeve 3 but not used for development is pushed upward by the toner which is newly supplied from the lower part of the space 9 surrounded by the regulating blade 2 and the partition member 5, then moved from the upper part of the space 9 to the toner hopper 6. That is, the circulation route of toner in the developing apparatus 1 includes the space 9, and toner flows from bottom to top within the space 9. Thereby, good flow of toner is formed in the proximity of the development sleeve 3. Therefore, the following situation will be prevented: 1) since same toner particles are repeatedly stressed by regulation of the regulating blade 2, tonerparticles crack; 2) cracked tinyparticles of toner melt and adhere to the development sleeve 3; or 3) the regulating blade 2 gets stiff due to the cracked toner adhering thereto.

As explained in the foregoing description, in the developing apparatus 1 according to this embodiment, the partition member 5 is provided and the partition member 5 and the regulating blade 2 form the space 9. Toner is supplied from lower part to upper part within the space 9 then, toner present in the proximity of the development sleeve 3 is circulated. Therefore, the following situation will be prevented: 1) since same toner particles are repeatedly stressed by regulation of the regulating blade 2, toner particles crack; 2) cracked tiny particles of toner melt and adhere to the development sleeve 3; or 3) the regulating blade 2 gets stiff due to the cracked toner adhering thereto. Further, since constant amount of toner is always collected within the space 9, appropriate pressure of toner is applied at the regulating position when the regulating blade 2 takes toner into the space 9.

The present embodiment is an example and does not limit the present invention in any respect. Accordingly, the present invention can be variously improved and changed within the scope not departing the subject matter thereof. For example, the partition member 5 is made to contact with the supply roller 4 in this embodiment, however, the partition member 5 can be made contact with the development sleeve 3.

[Second Embodiment]

Figure 6:
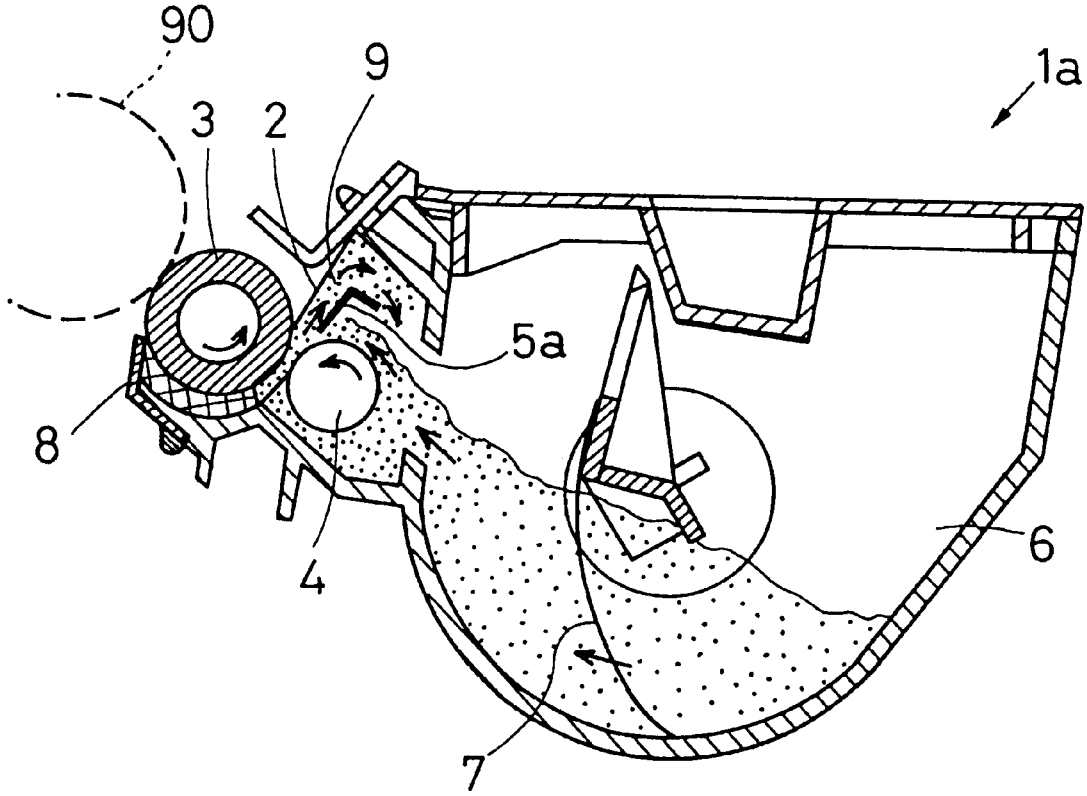
FIG. 6 is a schematic diagram showing a developing apparatus according to the second embodiment.

Next, the second embodiment will be explained. In a developing apparatus la according to the second embodiment, its entire structure and operation is almost same as the developing apparatus 1 according to the first embodiment. As shown in FIG. 6, the only difference is that a partition member 5*a* does not contact with a supply roller 4.

Similar to the first embodiment, in this embodiment, circulation route of toner in the developing apparatus 1*a* includes the space 9 which the regulating blade 2 and a partition member 5*a* form. Toner flows from bottom to top within the space 9. Since the partition member 5*a* is made apart from the supply roller 4, toner present in the space 9 has to be prevented from flowing backward. Then, the relation between the space between the partition member 5 and the supply roller 4 and circulation condition of toner will be explained with Table 2. As shown in the Table 2, at initial use wherein fresh toner is used, backward flow of toner does not occur and toner circulates without problems as long as a space between the partition member 5*a* and the supply roller 4 does not exceed 1.5 mm. On the other hand, after durable use wherein toner is hard to get charged and cracks easily due to durable use, backward flow of toner occurs, and circulation of toner deteriorates when a space between the partition member 5*a* and the supply roller 4 exceeds 1.0 mm. Therefore, when the partition member 5*a* is made not to contact with the supply roller 4, the space between the partition member 5a and the supply roller 4 may be set at less than 1.0 mm. That is, since thin layer of toner of about 20 μm is formed on the development sleeve 3 according to this embodiment, the space between the partition member 5*a* and the supply roller 4 should be set within a rage, longer than the thickness of thin layer of toner and shorter than fifty times of the thickness of thin layer of toner.

TABLE 2

| SPACE (mm) | STATE OF TONER AT INITIAL USE | STATE OF TONER-FLUIDITY DETERIORATION AFTER DURABLE USE |
|---|---|---|
| 1.5 | ○ | X~Δ |
| 1.2 | ○ | Δ~○ |
| 1.0 | ○ | ○ |
| 0.8 | ○ | ○ |
| 0.5 | ○ | ○ |

(○: GOOD X: BAD)

Even when the partition member 5*a* is made not to contact with the supply roller 4, backward flow of toner present in the space 9 is prevented by setting length of the space between the partition member 5*a* and the supply roller 4 at value specified above. Thereby, the toner present in proximity of the development sleeve 3 circulates smoothly. Accordingly, the following situation will be prevented: 1) since same toner particles are repeatedly stressed by regulation of the regulating blade 2, toner particles crack; 2) cracked tiny particles of toner melt and adhere to the development sleeve 3; or 3) the regulating blade 2 gets stiff due to the cracked toner adhering thereto. Further, since constant amount of toner is always collected within the space 9, appropriate pressure of toner is applied at the regulating position when the regulating blade 2 takes toner into the space 9.

The present embodiment is an example and does not limit the present invention in any respect. Accordingly, the present invention can be variously improved and changed within the scope not departing the subject matter thereof. For example, although a space between the partition member 5*a* and the supply roller 4 is made smaller than 1.0 mm in this embodiment, same effect can be obtained by making a space between the partition member 5*a* and the development sleeve 3 smaller than 1.0 mm regardless of length of the space between the partition member 5*a* and the supply roller 4.

[Third Embodiment]

Figure 7:
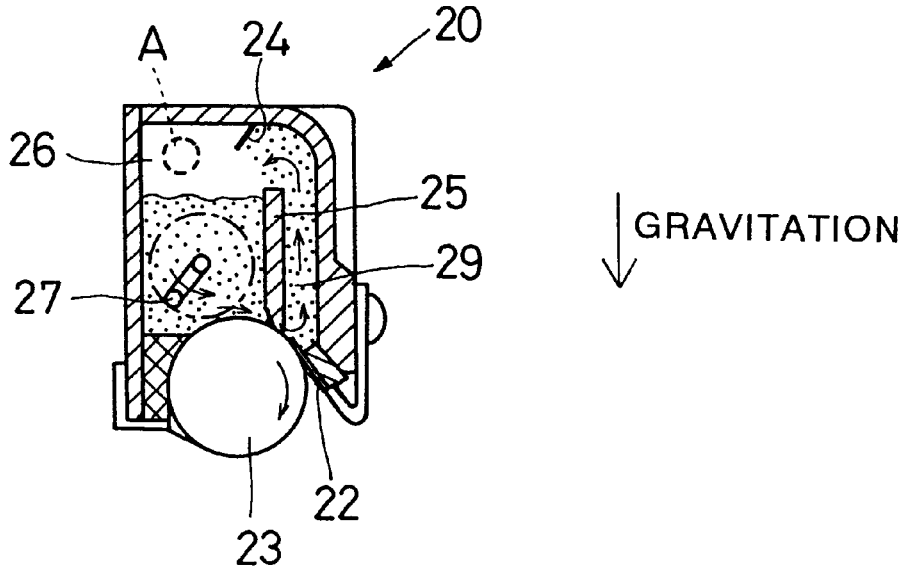
FIG. 7 is a schematic diagram showing a developing apparatus according to the third embodiment.

Next, the third embodiment will be explained. A developing apparatus 20 according to the third embodiment has: a development sleeve 23 for carrying developer; a toner hopper 26 for accommodating toner to be supplied to the development sleeve 23; a partitionmember 25 for forming a space 29 within the toner hopper 26; and a stirring member 27 for stirring toner present in the toner hopper 26; as shown in FIG. 7. The development sleeve 23 is rotatably arranged with a part of it protruding from the lower part of the toner hopper 26. The partition member 25 and the stirring member 27 are arranged in parallel above the development sleeve 23. At the downstream for rotating direction of the developing sleeve 23 above of which the partition member 25 contacts with the development sleeve 23, a regulating blade 22 is arranged and its edge is bent in a certain angle to press and contact with the development sleeve 23. Moreover, an opening A and a visor 24 are arranged at the upper part of the toner hopper 26. Thereby, toner is supplied to the toner hopper 26 from a toner tank which is not shown in the FIG. 7 and the supplied toner is prevented from flowing into the space 29.

In this embodiment, gravitation and rotation of the stirring member 27, and the development sleeve 23 transport and circulate toner within the developing apparatus 20. That is, toner present in the toner hopper 26 is supplied to the development sleeve 23 being stirred by the stirring member 27. Then, toner transported by rotation of the development sleeve 23 is supplied to a space 29 surrounded by the partition member 25 and the sidewall of the toner hopper 26 after regulated by the partition member 25. The toner supplied into the space 29 is further regulated by the regulating blade 22 and then taken onto the development sleeve 23. Since appropriate amount of toner is collected in the space 29, appropriate pressure of toner can be obtained at the regulating position when toner is taken onto the development sleeve 23 by the regulating blade 22.

Toner supplied to the space 29 but not used for development is pushed upward by toner newly supplied to the lower part of the space 29, and then is moved to the toner hopper 26 from the upper part of the space 29. That is, the circulation route of toner in the developing apparatus 20 includes the space 29 and toner flows from bottom to top within the space 29. Thereby, good flow of toner is formed in the proximity of the development sleeve 23. Therefore, the following situation will be prevented: 1) since same toner particles are repeatedly stressed by regulation of the regulating blade 22, toner particles crack; 2) cracked tiny particles of toner melt and adhere to the development sleeve 23; or 3) the regulating blade 22 gets stiff due to the cracked toner adhering thereto.

Height of the partition member 25 will be explained herein. In this embodiment, the developing apparatus 20 uses a development sleeve 23 of 16 mm in diameter which is same as the one used in the first embodiment. The development sleeve is made to run 200 mm/s and is assumed to print about 20 sheets of A4-sized paper per minute. In this case, it is verified that toner circulates smoothly when height of the partition member 25 is 17 mm and the sectional area of entrance for the space 29 is made equal to that of exit. Still, the height of the partition member 25 is preferably made higher than 17 mm because the toner hopper 26 is hard to secure sufficient accommodation capacity of toner when the height of the partition member 25 is made shorter than 17 mm.

When durability evaluation test is made under the aforementioned preferable condition, it is proved that the developing apparatus 20 can print 250 sheets of A4-sized paper wherein five-percent area of A4 size is filled with black images, all of the images are excellent. In order to make this performance feasible, a conventional developing apparatus requires a cross sectional area of about 2,500 $mm^2$, on the other hand, the developing apparatus 20 according to this embodiment requires only a cross sectional area of about 1,200 $mm^2$ (40 mm high, 30 mm wide), which is noticeably compact.

That is, the developing apparatus 20 according to the third embodiment, the development sleeve 23 is rotatably arranged with a part of it protruding from the lower part of the toner hopper 26. The partition member 25 and the stirring member 27 are arranged in parallel above the development sleeve 23. Toner present in the vicinity of the development sleeve 23 is smoothly circulated by supplying toner from the lower part of the space 29 surrounded by the partition member 25 and side wall of the toner hopper 26. Thereby, the following situation will be prevented: 1) since same toner particles are repeatedly stressed by regulation of the regulating blade 22, toner particles crack; 2) cracked tiny particles of toner melt and adhere to the development sleeve 23; or 3) the regulating blade 22 gets stiff due to the cracked toner adhering thereto. Further, since constant amount of toner is always collected within the space 29, appropriate pressure of toner is applied at the regulating position when the regulating blade 22 takes toner into the space 29. Moreover, this structure makes a developing apparatus noticeably compact.

Figure 8:
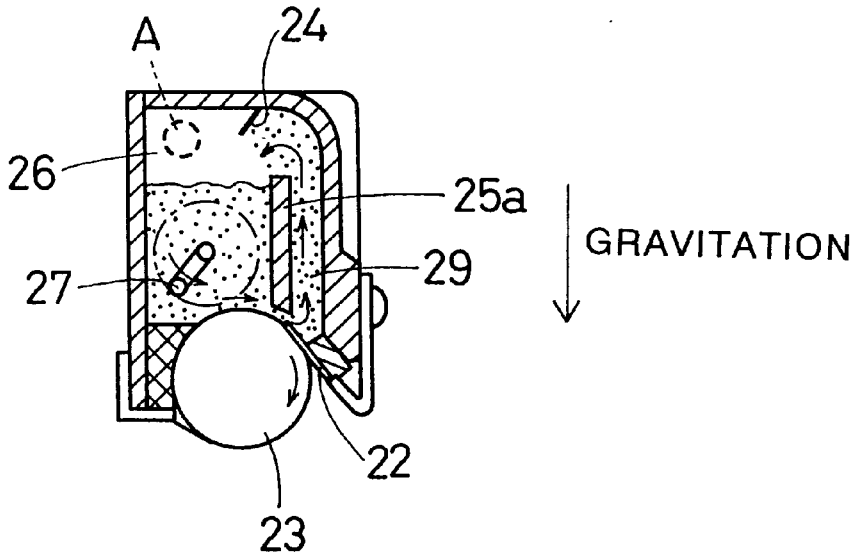
FIG. 8 is a schematic diagram showing a variant of a developing apparatus according to the third embodiment.

The present embodiment is an example and does not limit the present invention in any respect. Accordingly, the present invention can be variously improved and changed within the scope not departing the subject matter thereof. For example, the partition member 25 is made to contact with the development sleeve 23, in this embodiment, however, same effect can be obtained when the partition member 25*a* is not made to contact with the development sleeve 23 as shown in FIG. 8. However, a space between the partition member 25*a* and the development sleeve 23 has to be made smaller than 1.0 mm in this case. This is to prevent toner collected within the space 29 surrounded by the partition member 25*a* and sidewall of the toner hopper 26 from flowing backward through the space which is bigger than 10.0 mm.

[Fourth Embodiment]

Figure 9:
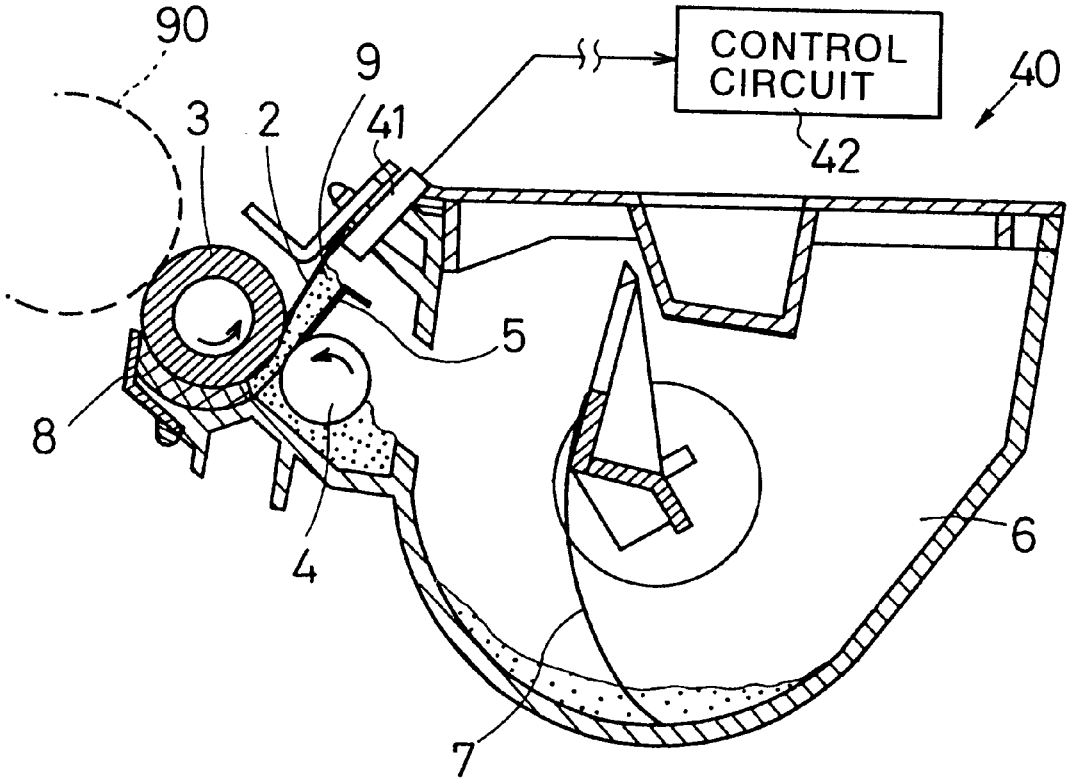
FIG. 9 is a schematic diagram showing a developing apparatus according to the fourth embodiment.

Next, the fourth embodiment will be explained. In a developing apparatus 40 according to the fourth embodiment, its entire structure and operation is almost same as the developing apparatus 1 according to the first embodiment. In addition, function to sense toner-empty is applied thereto. More specifically, as shown in FIG. 9, a displacement sensor 41 for sensing displacement of upper surface of toner preset in a space 9 surrounded by the regulating blade 2 and the partition member 5 is arranged above the space 9. Its output information is made to be input in a control circuit 42 installed in main body of the developing apparatus.

In this embodiment, similar to the first embodiment, the partition member 5 is provided to form the space 9 surrounded by the partition member 5 and the regulating blade 2. Toner is supplied from lower part to upper part in the space 9 then, toner present in the proximity of the development sleeve 3 is circulated. Thereby, the following situation will be prevented: 1) since same toner particles are repeatedly stressed by regulation of the regulating blade 2, toner particles crack; 2) cracked tiny particles of toner melt and adhere to the development sleeve 3; or 3) the regulating blade 2 gets stiff due to the cracked toner adhering thereto. Further, since constant amount of toner is always collected within the space 9, appropriate pressure of toner is applied at the regulating position when the regulating blade 2 takes toner into the space 9.

Further, the displacement sensor 41 senses displacement of upper surface of toner present in the space 9. Since constant amount of toner is present in the space 9 in normal condition, upper surface position of toner is constant and therefore, output value obtained by the displacement sensor 41 is steady. However, when toner in the toner hopper 6 runs out, toner present in the space 9 is nothing but consumed and the upper surface position of toner starts getting down and then, output value obtained by the displacement sensor 41 changes. Accordingly, toner-empty can be accurately sensed by output change of the displacement sensor 41.

The present embodiment is an example and does not limit the present invention in any respect. Accordingly, the present invention can be variously improved and changed within the scope not departing the subject matter thereof. For example, a displacement sensor can be attached to the developing apparatus 20 according to the third embodiment. Thereby, the developing apparatus 20 can sense toner-empty accurately.

[Fifth Embodiment]

Figure 10:
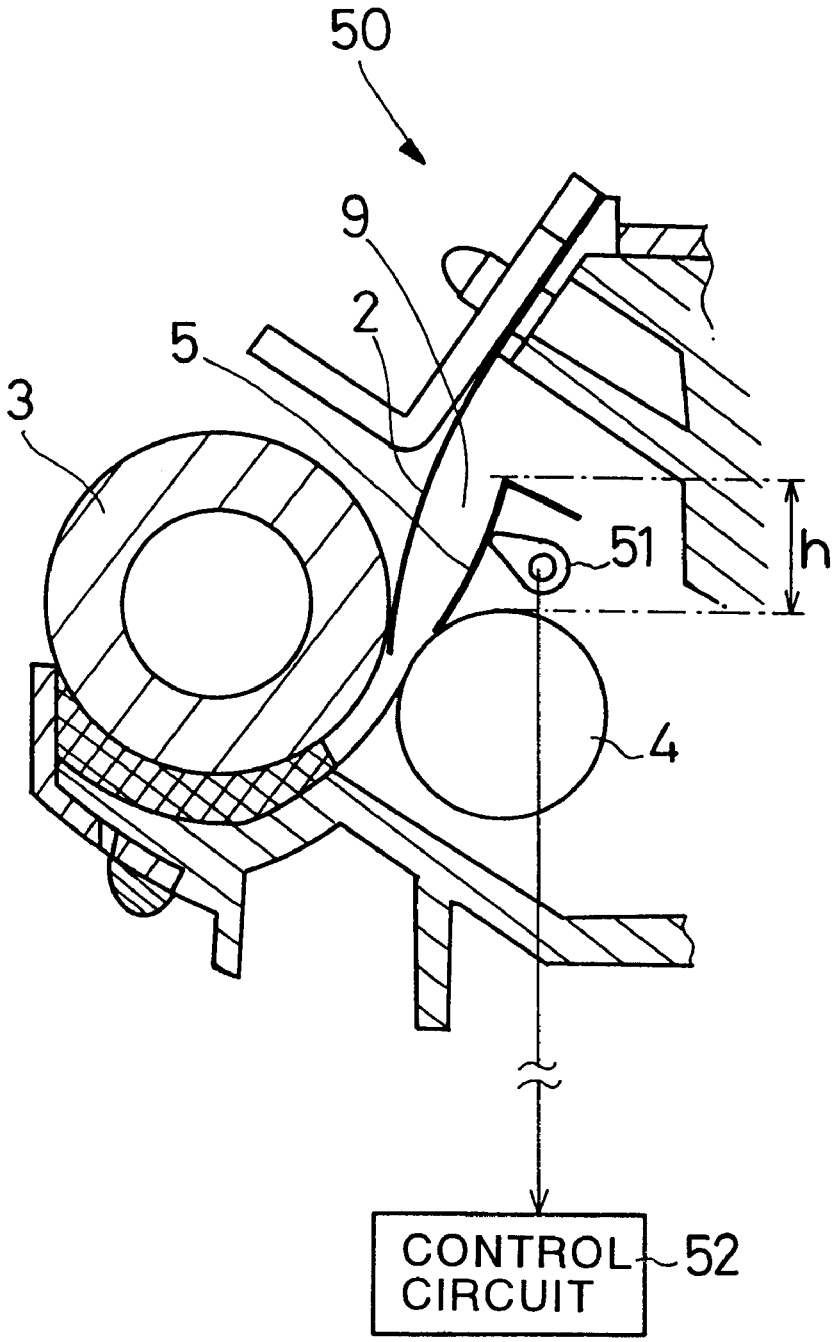
FIG. 10 is a schematic diagram showing a developing apparatus according to the fifth embodiment.

Finally, the fifth embodiment will be explained. In a developing apparatus 50 according to the fifth embodiment, its entire structure and operation is almost same as the developing apparatus 1 according to the first embodiment. A difference is that height of a partition member 5 is variably controlled. More specifically, as shown in FIG. 10, a cam 51 for changing height h for the partition member 5 is provided. A control circuit 52 installed in main body of the developing apparatus 50 controls driving of the cam 51. That is, optimum value of height for the partition member 5 is beforehand stored in a ROM of the control circuit 52 as a table and thereby, rotating angle of the cam 51 is determined based on information concerning the number of sheets to be printed, humidity and so on.

Height of toner which can be transported varies in response to flow speed and fluidity of toner. Flow speed of toner varies according to change of printing speed. Fluidity of toner varies according to change of toner after durable use, and environmental change due to change of electrostatic force or cross-linking force of liquid. Therefore, height of the partition member 5 needs to be set at a predetermined position at the beginning so as to cope with printing speed. Moreover, height of the partition member 5 needs to be changed so as to cope with change of fluidity.

In this embodiment, the cam 51 is set at a predetermined angle and height of the partition member 5 is set at initial value when power supply is turned on. Initial value is different by each type of developing apparatus. The optimum value is set based on printing speed of each developing apparatus. Similar to the first embodiment, toner is supplied from the lower part of the space 9 surrounded by the regulating blade 2 and the partition member 5, and toner present in the proximity of the development sleeve 3 is smoothly circulated.

Figure 11:
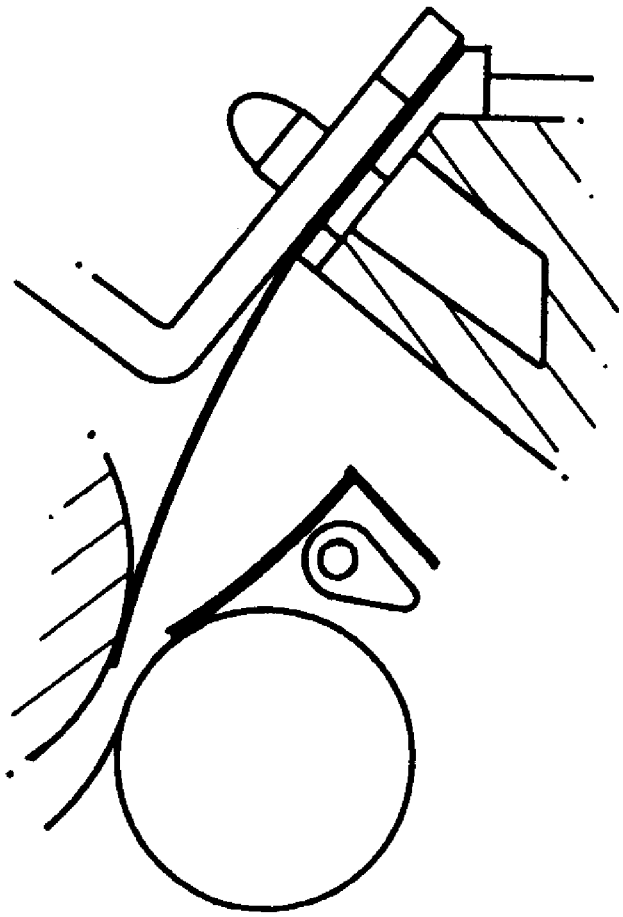
FIG. 11 shows a state of a cam when height of a partition member is changed.
Figure 12:
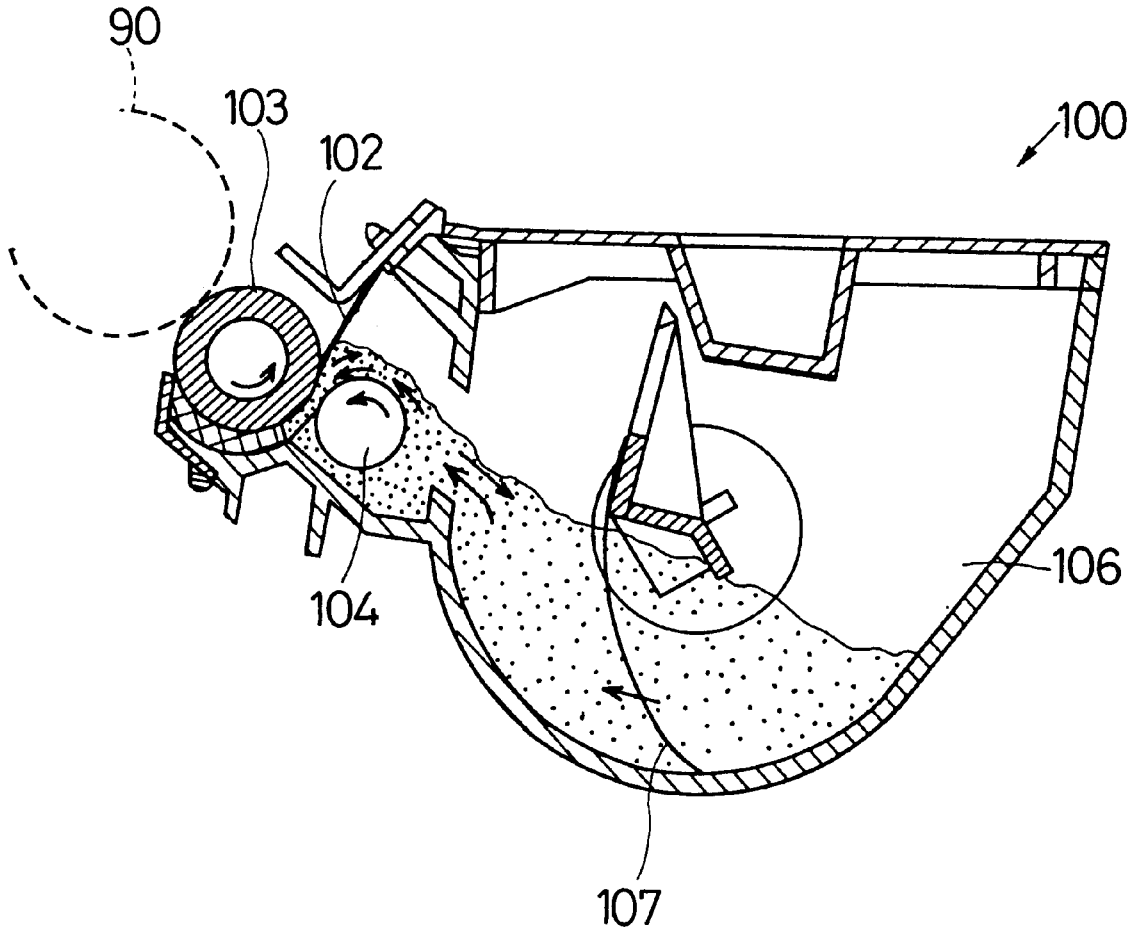
FIG.12 PRIOR ART
FIG. 12 is a schematic diagram showing a conventional developing apparatus.

Smooth circulation of toner in the developing apparatus 50 becomes hard to maintain when operation environment (the number of sheets to be printed and humidity) for the developing apparatus 50 changes. However, in this embodiment, height of the partition member 5 is adjusted to an optimum height by making the cam 51 drive by a certain angle which is predetermined based on information concerning the number of sheet to be printed, humidity and so on. For example, when the cam 51 gets rotated by about 180 degrees under the state of FIG. 10, the height of the partition member 5 becomes low as shown in FIG. 11. Thereby, excellent circulation of toner in the developing apparatus 50 is always maintained.

That is, in the fifth embodiment, height of the partition member 5 is made variable by making the cam 51 drive based on information concerning the number of sheets to be printed, humidity and so on. Thereby, excellent circulation of toner in the developing apparatus 50 is always maintained even when operation environment (the number of sheets to be printed and humidity) for the developing apparatus 50 changes. Accordingly, toner present in the proximity of the development sleeve 3 is smoothly circulated. Thereby, the following situation will be prevented: 1) since same toner particles are repeatedly stressed by regulation of the regulating blade 2, toner particles crack; 2) cracked tiny particles of toner melt and adhere to the development sleeve 3; or 3) the regulating blade 2 gets stiff due to the cracked toner adhering thereto. Further, since constant amount of toner is always collected within the space 9, appropriate pressure of toner is applied at the regulating position when the regulating blade 2 takes toner into the space 9.

The present embodiment is an example and does not limit the present invention in any respect. Accordingly, the present invention can be variously improved and changed within the scope not departing the subject matter thereof. For example, in this embodiment, the cam 51 is used in order to change height of the partition member 5, however, solenoid can be used. Same effect can be obtained by making vibrate the partition member 5 instead of changing the height of it.

What is claimed is:

1. A developing apparatus including:

a developer carrier for carrying mono-component developer;

a regulating member contacting with the developer carrier;

a partition member:

a space located between said regulating member and said partition member, said space having an upper opening and a lower opening and including a regulating position at which the developer carrier and the regulating member contact in the vicinity of the lower opening;

a developer tank for accommodating the mono-component developer; and a supply unit;

wherein the supply unit does not supply the mono-component developer in the supply tank to the upper opening directly but supplies the mono-component developer from the lower opening to the upper opening and includes a supply device for collecting excessive mono-component developer to the developer tank;

the developing apparatus being configured such that the excessive mono-component developer is collected and accommodated within the developer tank without being collected by the developer carrier after the excessive mono-component developer has exited from the upper opening.

2. A developing apparatus according to claim 1, wherein the supply unit includes a supply roller, the partition member contacting said supply roller.

3. A developing apparatus according to claim 1, wherein a space between the partition member and the developer carrier is shorter than 1 mm.

4. A developing apparatus including:

a developer carrier for carrying developer;

a regulating member contacting with the developer carrier;

a space having an upper opening and a lower opening and including a regulating position at which the developer carrier and the regulating member contact in the vicinity of the lower opening;

a developer tank for accommodating developer; and a supply unit;

wherein the supply unit does not supply developer in the supply tank to the upper opening directly but supplies developer from the lower opening to the upper opening and includes a supply device for collecting excessive developer to the developer tank;

wherein the space is a space surrounded by the regulating member and a partition member;

wherein the partition member contacts with the developer carrier.

5. A developing apparatus according to claim 4, wherein pressure of the partition member to press the developer carrier is lower than that of the regulating member to press the developer carrier.

6. A developing apparatus including:

a developer carrier for carrying developer;

a regulating member contacting with the developer carrier;

a space having an upper opening and a lower opening and including a regulating position at which the developer carrier and the regulating member contact in the vicinity of the lower opening;

a developer tank for accommodating developer;

a supply unit; and wherein the supply unit does not supply developer in the supply tank to the upper opening directly but supplies developer from the lower opening to the upper opening and includes a supply device for collecting excessive developer to the developer tank;

wherein the supply device includes a rotating roller which is arranged at the proximity of the lower opening.

7. A developing apparatus according to claim 6, wherein a space between the partition member and the rotating roller is shorter than 1 mm.

8. A developing apparatus according to claim 6, wherein the supply device further includes a stirring member for supplying developer to the rotating roller.

9. A developing apparatus including:

a developer carrier for carrying developer;

a regulating member contacting with the developer carrier;

a space having an upper opening and a lower opening and including a regulating position at which the developer carrier and the regulating member contact in the vicinity of the lower opening;

a developer tank for accommodating developer;

a supply unit; and wherein the supply unit does not supply developer in the supply tank to the upper opening directly but supplies developer from the lower opening to the upper opening and includes a supply device for collecting excessive developer to the developer tank;

wherein the supply device includes a rotating roller which is arranged at the proximity of the lower opening;

wherein the space is a space divided by the regulating member and the partition member and the partition member contacts with the rotating roller.

10. A developing apparatus according to claim 9, wherein pressure of the partition member to press the rotating roller is lower than that of the regulating member to press the developer carrier.

11. A developing apparatus according to claim 1, wherein the regulating member is a blade.

12. A developing apparatus including:

a developer carrier for carrying developer;

a regulating member contacting with the developer carrier;

a space having an upper opening and a lower opening and including a regulating position at which the developer carrier and the regulating member contact in the vicinity of the lower opening;

a developer tank for accommodating developer;

a supply unit; and a toner-empty sensor for sensing at least one of presence of developer or absence of developer within the space;

wherein the supply unit does not supply developer in the supply tank to the upper opening directly but supplies developer from the lower opening to the upper opening and includes a supply device for collecting excessive developer to the developer tank.

13. A developing apparatus according to claim 1 further includes a changing device for changing volume of the space.

14. A developing apparatus according to claim 13, wherein the changing device includes a moving device for moving the partition member.

15. A developing apparatus including:

a developer carrier for carrying developer;

a regulating member contacting with the developer carrier;

a space having an upper opening and a lower opening and including a regulating position at which the developer carrier and the regulating member contact in the vicinity of the lower opening;

a developer tank for accommodating developer;

a supply unit; and a changing device for changing volume of the space;

wherein the supply unit does not supply developer in the supply tank to the upper opening directly but supplies developer from the lower opening to the upper opening and includes a supply device for collecting excessive developer to the developer tank;

wherein the changing device changes a volume of the space based on operation-environment information the developing apparatus.

16. A developing apparatus according to claim 1 satisfies the expression below:

$$0.8 \leqq (\text{sectional area of the upper opening}/\text{sectional area of the lower opening}) \leqq 3.0.$$

* * * * *